US009417010B2

(12) United States Patent
Wolf et al.

(10) Patent No.: US 9,417,010 B2
(45) Date of Patent: Aug. 16, 2016

(54) DIRECT CONTACT CONDENSER

(71) Applicant: ALSTOM Technology Ltd, Baden (CH)

(72) Inventors: Hartwig Wolf, Ennetbaden (CH); Francisco Blangetti, Baden (CH); Peter Rusche, Wettingen (CH)

(73) Assignee: ALSTOM Technology Ltd, Baden (CH)

( * ) Notice: Subject to any disclaimer, the term of this patent is extended or adjusted under 35 U.S.C. 154(b) by 53 days.

(21) Appl. No.: 14/488,361

(22) Filed: Sep. 17, 2014

(65) Prior Publication Data

US 2015/0035176 A1 Feb. 5, 2015

Related U.S. Application Data

(63) Continuation of application No. PCT/EP2013/055614, filed on Mar. 19, 2013.

(30) Foreign Application Priority Data

Mar. 19, 2012 (EP) ..... 12160195

(51) Int. Cl.

| | |
|---|---|
| ***B01F 3/04*** | (2006.01) |
| ***F28B 3/02*** | (2006.01) |
| ***F28B 3/04*** | (2006.01) |
| ***F28F 25/04*** | (2006.01) |
| ***F28B 9/04*** | (2006.01) |

(52) U.S. Cl.

CPC ..... *F28B 3/04* (2013.01); *B01F 3/04475* (2013.01); *F28B 3/02* (2013.01); *F28B 9/04* (2013.01); *F28F 25/04* (2013.01)

(58) Field of Classification Search

CPC .... B01F 3/04; B01F 3/04007; B01F 3/04468; B01F 3/04475; F28B 3/02; F28B 3/00; F28B 9/04

USPC ..... 261/112.1, DIG. 10; 96/322, 327; 165/115, 914

See application file for complete search history.

(56) References Cited

U.S. PATENT DOCUMENTS

| | | | |
|---|---|---|---|
| 2,616,670 | A | 11/1952 | Van Der Molen |
| 3,814,398 | A | 6/1974 | Bow |

(Continued)

FOREIGN PATENT DOCUMENTS

| | | | |
|---|---|---|---|
| DE | 321082 | C | 5/1920 |
| FR | 839 816 | A | 4/1939 |

(Continued)

OTHER PUBLICATIONS

Kreith et al., "Heat Transfer Research for Ocean Thermal Energy Conversion", Journal of Heat Transfer, vol. No. 110, pp. 5-22, Feb. 1988.

*Primary Examiner* — Robert A Hopkins

(57) ABSTRACT

An apparatus for condensing steam is described including at least two chambers with a first chamber operated as co-current flow condensing chamber and a second chamber operated as counter-current flow condensing chamber with the co-current flow condensing chamber including a cooling liquid distribution system with a plurality of channels arranged above a plurality of film carriers having flat surface areas to carry films of cooling liquid.

12 Claims, 4 Drawing Sheets

(56) References Cited

U.S. PATENT DOCUMENTS

| | | | | | |
|---|---|---|---|---|---|
| 4,288,393 | A | | 9/1981 | Sekiguchi et al. | |
| 4,372,897 | A | | 2/1983 | Sanderson et al. | |
| 4,766,730 | A | | 8/1988 | Amano et al. | |
| 4,969,507 | A | * | 11/1990 | Rosenblad | F28B 1/00 165/111 |
| 5,925,291 | A | * | 7/1999 | Bharathan | F28B 3/02 261/112.2 |

FOREIGN PATENT DOCUMENTS

| | | | |
|---|---|---|---|
| FR | 1 398 655 | A | 5/1965 |
| GB | 10180 | A | 0/1910 |
| GB | 498715 | A | 1/1939 |

* cited by examiner 11
111
112
115
23

21
21
113

22
21
113

24
25
113

DIRECT CONTACT CONDENSER

CROSS-REFERENCE TO RELATED APPLICATIONS

This application claims priority to PCT/EP2013/055614 filed Mar. 19, 2013, which claims priority to European application 12160195.9 filed Mar. 19, 2012, both of which are hereby incorporated in their entireties.

TECHNICAL FIELD

The present invention relates to direct contact condensers for use in a power plant, particularly in a geothermal power plant.

BACKGROUND

Geothermal energy resources have generated considerable interest in recent years as an alternative to conventional hydrocarbon fuel resources. Fluids obtained from subterranean geothermal reservoirs can be processed in surface facilities to provide useful energy of various forms. Of particular interest is the generation of electricity by passing geothermal steam or vapor through a steam turbine coupled to an electric generator.

Several different types of geothermal power plants are known. These include, for example, direct cycle plants, flash steam plants, indirect cycle plants, binary cycle plants, and combined or hybrid plants. Direct cycle plants, which are of particular interest with regard to the current invention, include a steam turbine that is driven. directly by steam from the earth's interior. The steam after being expanded in the turbine is condensed in a condenser and released into the atmosphere or re-injected into subterranean formations.

The U.S. Pat. No. 5,925,291 describes a direct contact condenser for geothermal applications. Geothermal fluids typically comprise a variety of potential pollutants, including noncondensable gases (NCG) such as ammonia, hydrogen sulfide, and methane. Because of these contaminants, particularly hydrogen sulfide, discharging a geothermal vapor exhaust into the atmosphere is usually prohibited for environmental reasons. Thus, the conventional approach is to exhaust the turbine effluent into a steam condenser to reduce the turbine back pressure and concentrate the noncondensable gases for further downstream venting, treatment or elimination.

THE '291 patent further suggests that many geothermal power plants utilize direct contact condensers, wherein the cooling liquid and vapor intermingle in a condensation chamber, to condense the vapor exhausted from the turbine. Direct contact condensers are generally preferred over surface condensers in the case of vapor condensation with high content of non-condensable gases with corrosion potential. In the surface condensers the vapor releases its condensation heat to the circulating cooling water across a separation wall. This type of condensers is the preferred realisation of a cycle heat sink due to the excellent overall mean heat transfer coefficient obtainable for condensing pure (or quasi-pure) vapors in surface condensers.

However, for condensing steam with high non-condensable content (e.g. greater than 0.5% of mole fraction), the use of l the less efficient direct contact condenser are considered because of the gas film boundary layer, which increase enormously the thermal resistance for the heat transfer. To realize an optimal heat transfer efficiency using direct contact condensers, the cooling liquid must be introduced into the condensation chamber at a sufficiently high velocity to disperse the liquid into fine droplets, i.e., to form a rain, thereby increasing the surface area for condensation.

Unfortunately, this high velocity discharge reduces the contact time between the cooling liquid and the vapor, which in turn reduces the heat exchange efficiency. Consequently, conventional direct contact condensers require relatively large condensing chambers to compensate for this low heat transfer efficiency and to provide sufficient contact between the liquid and vapor to effect condensation.

As stated in the '291 patent, a possible way to increase the condensation efficiency, and thus to minimize the size of the direct contact condenser, is to inject the cooling liquid through a plurality of individual nozzles, which disperses the cooling liquid in the form of droplets or films. As films or droplets provide a greater surface area for condensation than normal liquid injection, the cooling liquid can be introduced into the chamber at a lower rate, i.e., without generating a rain of fine droplets. Although these spray-chamber condensers offer generally improved condensation efficiency and more compact designs than previous generation of condensers, they require substantial quantities of cooling liquid to obtain sufficient condensation. Therefore, and because of the additional energy requirements and losses associated with pumping the excess cooling liquid to the condensation chamber, the practical efficiency of these condensers remains still low.

The U.S. Pat. No. 3,814,398 discloses a direct contact condenser having a plurality of spaced-apart deflector plates angularly disposed relative to the cooling liquid inlet. The deflector plates are positioned to break up the cooling liquid into liquid fragments, thus generating a film of coolant. The condenser includes multiple spray chambers, wherein each chamber has deflector plates and a conduit for a liquid. Obvious disadvantages of this design are its complexity and high costs due to the large numbers of partitions, deflector plates, and liquid conduits required to generate the film.

The condenser described in the U.S. Pat. No. 5,925,291 has a downward vapor flow chamber and an upward vapor flow chamber, wherein each of the vapor flow chambers includes a plurality of cooling liquid supplying pipes and a vapor-liquid contact medium disposed thereunder to facilitate contact and direct heat exchange between the vapor and cooling liquid. The contact medium includes a plurality of sheets arranged to form vertical interleaved channels or passageways for the vapor and cooling liquid streams. The upward vapor flow chamber also includes a second set of cooling liquid supplying pipes disposed beneath the vapor-liquid contact medium which operate intermittently in response to a pressure differential within the upward vapor flow chamber. The condenser further includes separate wells for collecting condensate and cooling liquid from each of the vapor flow chambers. In alternate embodiments, the condenser includes a cross-current flow chamber and an upward flow chamber, a plurality of upward flow chambers, or a single upward flow chamber.

While providing an efficient cooling system, the condenser described in the '291 patent can often be difficult to manufacture and to maintain as it is challenging to form the interleaved channels from steel. The channels are equally not easy to clean in order to prevent fouling or scaling. It can therefore be seen as an object of the present invention to provide a compact and efficient direct contact condenser, which avoids the disadvantageous of the known cooling methods, particularly as applied to condensate steam from geothermal sources.

SUMMARY

According to an aspect of the present invention, there is provided an apparatus for condensing steam having at least two chambers with a first chamber operated as co-current flow condensing chamber and a second chamber operated as counter-current flow condensing chamber with the co-current flow condensing chamber including a cooling liquid distribution section including a plurality of channels arranged above a plurality of film carrier elements providing essentially flat surfaces for a continuous film to interface with the flow of steam.

In a preferred embodiment, the apparatus further includes a chamber and outlets for the removal of noncondensable gases (NCG).

In another preferred embodiment, the cooling liquid distribution section disperses the liquid to form a uniform film on the carriers at a very low pressure drop. The pressure drop when measured across the openings of the distribution channels into the counter-current flow condensing chamber is best designed to be less than 300 mbar or even less than 200 mbar.

In another preferred embodiment, the cooling liquid distribution section disperses the liquid such that the flow on the carrier is at least partially turbulent, preferably without the film being lifted from the surface. To assist in establishing a turbulent flow on the carrier, the film carrier can have a structured surface.

The film carriers are preferably with the exception of the surface structure essentially smooth plates of a metal, metal alloy or man-made materials, such as glass, polymeric or composite materials, which can be easily cleaned to remove deposits of the condensation process.

Within the chamber, the plates can be installed as vertical or near-vertical walls, i.e., oriented with an angle of preferably five degrees or less from the vertical or upright orientation.

In a further preferred embodiment, the plates are combined into modules with one or several modules forming a condenser unit for the power plant.

In a further preferred embodiment of the invention, the cooling liquid distribution section includes channels through which in operation the cooling liquid flows in mutually opposing directions before being distributed onto the film carriers. In a variant of the embodiment, the channels are split into two sets of channels with the coolant flowing in a first direction in one set and into the opposite direction in the other set of channels.

If considered efficient, the plates can also be formed into tubes, half-tubes and other shapes, all which are capable of providing a surface to allow a relatively unimpeded flow of the cooling liquid film from the liquid distribution system at the top to the coolant collection at the bottom of the apparatus.

These and further aspects of the invention will be apparent from the following detailed description and drawings as listed below.

BRIEF DESCRIPTION OF THE DRAWINGS

Exemplary embodiments of the invention will now be described, with reference to the accompanying drawings, in which.

DETAILED DESCRIPTION

Aspects and details of examples of the present invention are described in further details in the following description using the example of a condenser unit designed for a geothermal power plant. The steam flow from the geothermal source is assumed to carry a large fraction of noncondensable gases.

Figure 1A:
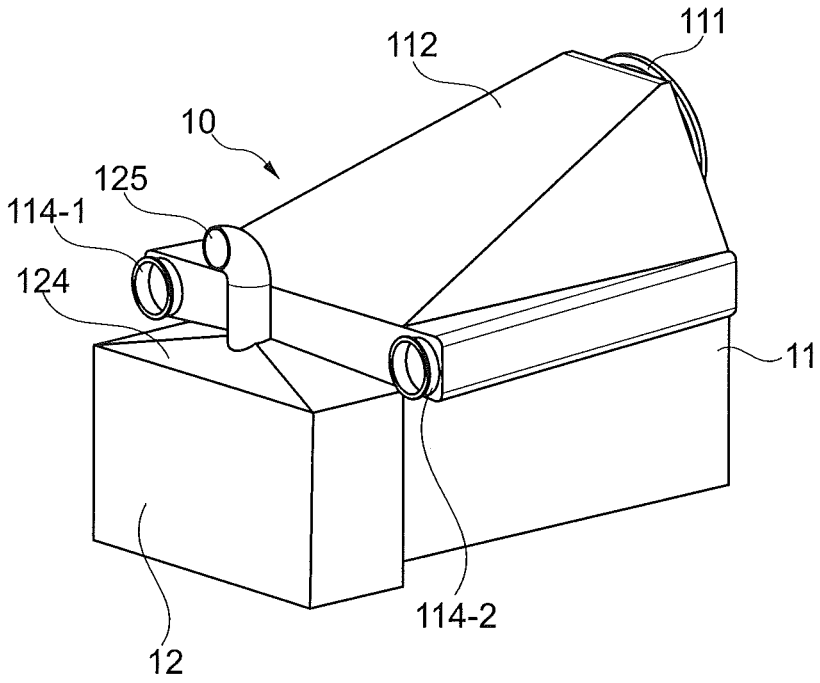
FIGS. 1A, B are schematic perspective views of a direct contact condenser in accordance with an example of the invention.
Figure 1B:
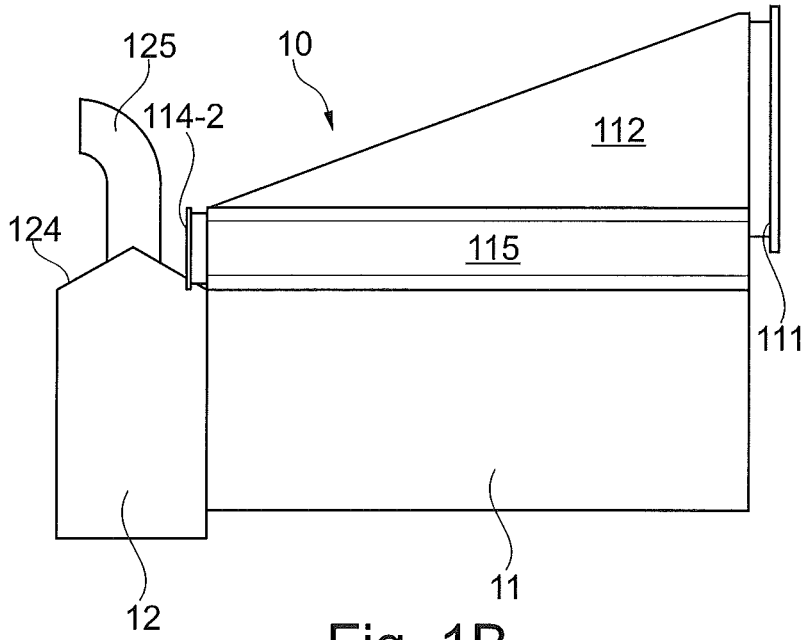

As shown in the perspective views of FIGS. 1A and 1B showing a direct contact condenser in accordance with an example of the present, the condenser 10 is divided into at least two compartments 11, 12. The first compartment 11 houses a co-current flow condensing stage, which is designed to perform the main part of the condensation process. The second compartment 12 houses a condensing stage in counter-current flow arrangement. The second stage is designed to mainly strip the water from the noncondensable gases.

Part of the first compartment 11 is an inlet 111 guiding the steam from the exhaust of a turbine into a hood or condenser neck 112. Further conduits 114-1, 114-2 are used to inject water into the first compartment 11 of the condenser 10 from opposite directions. These conduits provide the cooling liquid to the cooling liquid dispenser system described below. After passing through the two-stage condenser 10, the non-condensable gases are collected in a second hood 124 and extracted through the extraction pipe 125.

The schematic cross-sections of FIG. 2 show further details of the condenser of FIG. 1. Beneath the hood or condenser neck 112 the steam passes through the liquid dispenser system or head 115 before entering a section including a plurality of vertically arranged plates 113 which make up the bulk of the first condenser unit 11. The conduits 114-1, 114-2 provide the cooling liquid to the cooling liquid dispenser system 115, which located above the vertically arranged plates 113. The bottom 116 of the first compartment is essentially formed as a collection chamber or hot well for the cooling liquid and the portion of steam condensed in it and any amount of dissolved gases. The hot well 116 has an overflow into the hot well of the next compartment 12 and an additional outlet 117, through which in the current example the water is driven by a pump 118 so as to be capable of controlling the temperature of the cooling liquid at the exit of the condensing stages.

The residual steam, after having passed through the first condensation stage in equi-current or co-current flow arrangement within the first compartment 11, then enters the second compartment 12. The second compartment 12 houses a second condenser unit 121 operating in a counter-current flow arrangement. The second condenser unit can be a conventional packed bed condenser with the cooling liquid distributed across the packed bed 122 by spraying nozzles 123 located at the top of the condenser unit 121. The packing bed is only one potential option of a low-pressure drop gas-liquid contactor. Perforated plates, valve plates, bubble trays plates are possible alternatives to the packed-bed towers. The second unit 121 is designed to strip steam from the mixture for obtaining an enrichment in non-condensable gases, which are then collected by the hood 124 and extracted through the pipe 125.

The second condenser unit 121 further includes another hot well 126 for the water stripped out of the flow of steam and gases. The hot well 126 is connected to a pump and piping system 127 for ducting the hot well water to the circuit for an external cooling device (e.g. a cooling tower, water-water cooler, etc) for processing, recirculation, disposal etc.

Figure 2A:
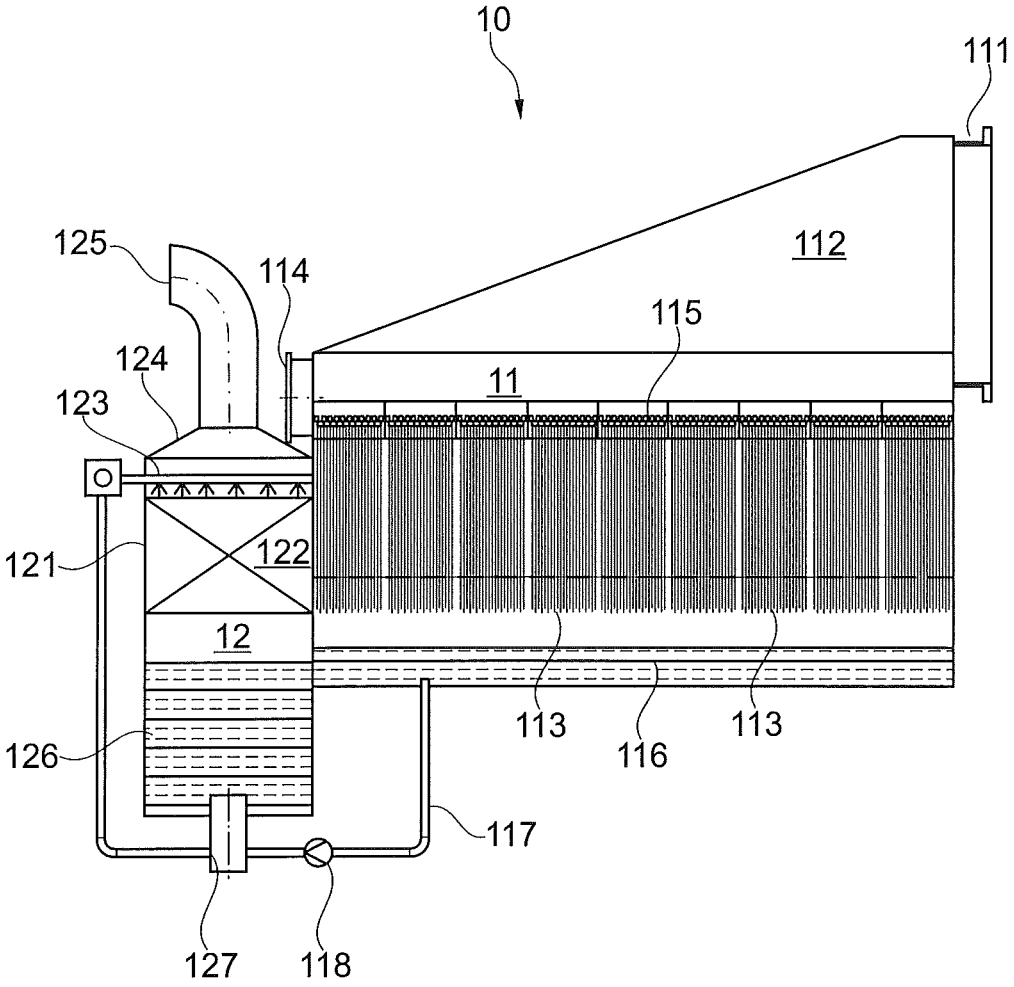
FIGS. 2A-2F show a schematic vertical cross-section and further details of the direct contact condenser of FIG. 1.
Figures 2B, 2C, 2D, 2F:
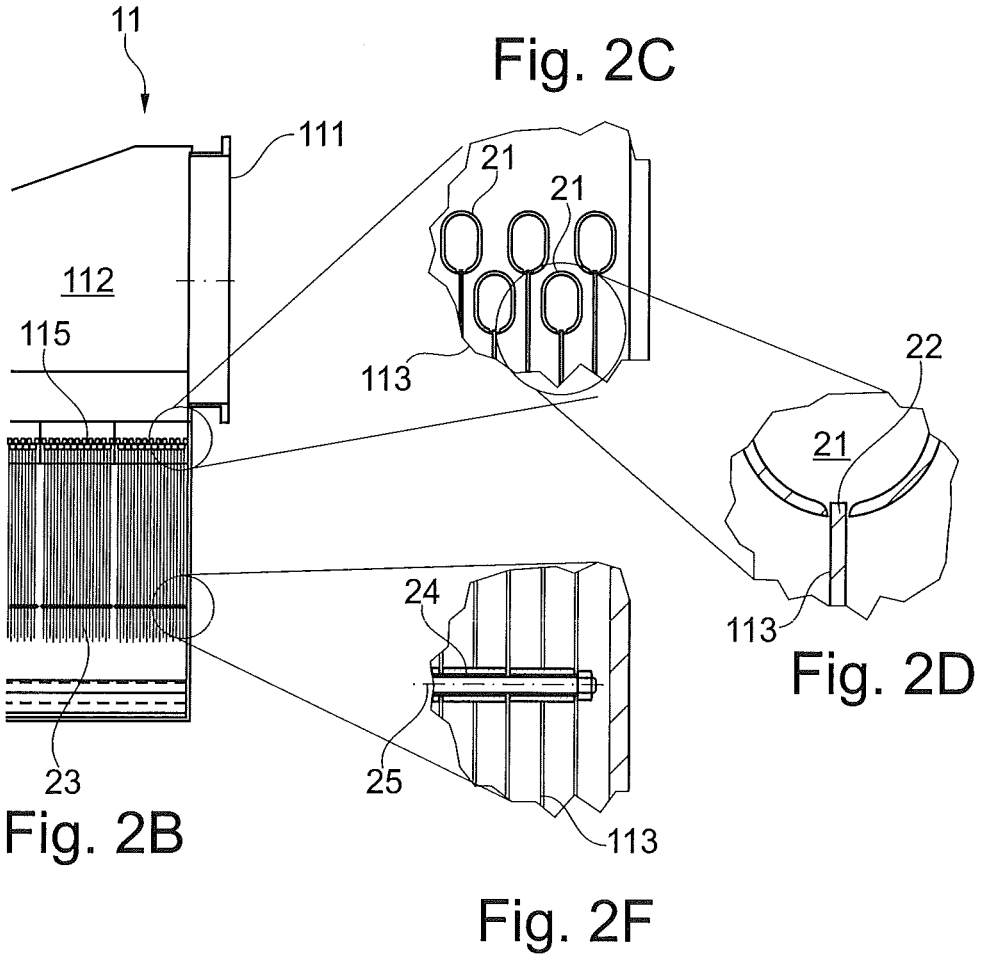

Further details of the liquid dispenser system are shown in FIGS. 2B-2D. The cooling water supply 115 for the condensing modules provided by the two conduits 114-1, 114-2 located at the top of the sidewalls distributes the cooling water into plurality of the feeding pipes 21. As shown in further detail in FIG. 2C, the lower row of feeding pipes 21 is shifted relative to the upper row vertically by approximately one pipe diameter and horizontally by half a pipe diameter being about 40 mm in the example described.

This or similar arrangements are chosen to ensure a dense grid of feeding pipes 21 above the plates 113 while at the same time allowing a relatively unimpeded flow of stream through the grid of feeding pipes and along the plates faces. The feeding pipes 21 are designed to distribute as uniformly as possible a thin film of cooling liquid along the top section of the plates 113. In the example, this is achieved by letting the top part of each film carrier plate 113 enter into a slit 22 cut into the bottom of the feeding pipe 21 as illustrated in FIG. 2D. The width of the slit is in the range of 0.5 mm to 2 mm at each side of the top of the plate 113 to ensure that the flow of cooling liquid sticks to the plate and that the pressure drop across the openings or slits does not exceed 200 mbar. Thus, the cooling liquid flowing through the feeding pipe 21 runs off smoothly along both, the front and back face of the plates 113.

Figure 2E:
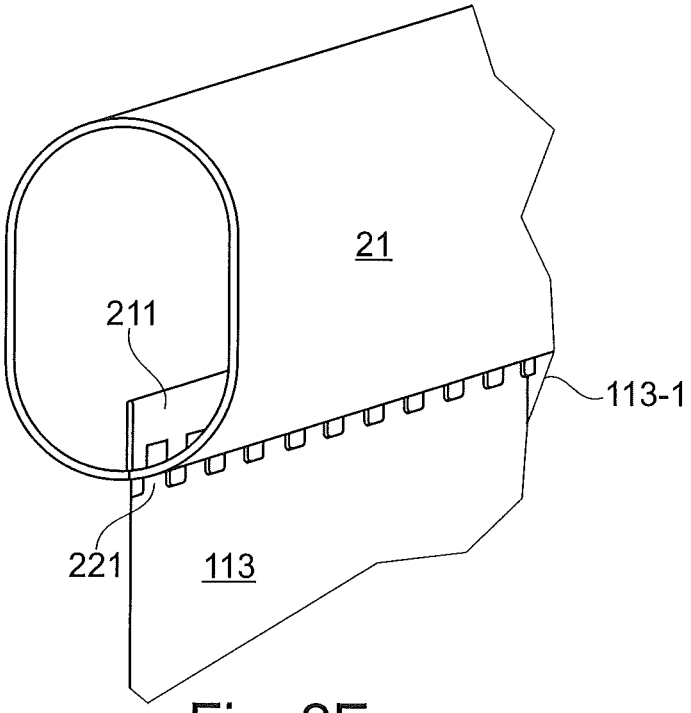

In the embodiment FIG. 2E, there is shown an exemplary way of attaching the plates 113 to the feeding pipes 21. Each plate 113 is held in position within the slit 22 by a further metal sheet 211. This clamping sheet 211 has toothed end sections and is bent into a tight U-shape. The top of the film carrier plates 113 is welded, bolted or clamped into the U-bent such that the toothed end sections provide a plurality of short channels 221 between the bottom of the feeding pipe and the clamped plate 113. The plates can be further stabilized by short stiffening plates or metal stripes 113-1 welded to the condenser plates 113 at a right angle.

It is seen as advantageous to use the conduits 114-1, 114-2 to direct cooling liquid into the feeding pipes 21 from opposite directions. For example the conduits 114-1, 114-2 can be used to feed alternatingly every second pipe 21. This mode of feed can balance any inhomogeneities caused by the flow direction of the coolant flow into the liquid dispenser system 115. It can also be used to switch the capacity of the condenser between a full and a half load by closing one of the conduits.

Also shown in FIG. 2A are plates 113 mounted in form of modules 23 with each module combining a plurality of plates 113, typically 10 to 40. The plates 113 of a module are welded together using hollow tubular elements 24—as spacer or tie-rods—as shown in greater detail in FIG. 2F. A module 23 is mounted to the housing of the condenser unit 11 by passing for example threaded rods 25 through the hollow tubular elements 24 and fixing the ends of the rod 25 to the housing or a support within the housing of the condenser unit 11. Other mechanical or chemical fixing methods such as nuts and bolts, welding or gluing can be used to hold the modules and the plates inside the modules in position.

Figure 3:
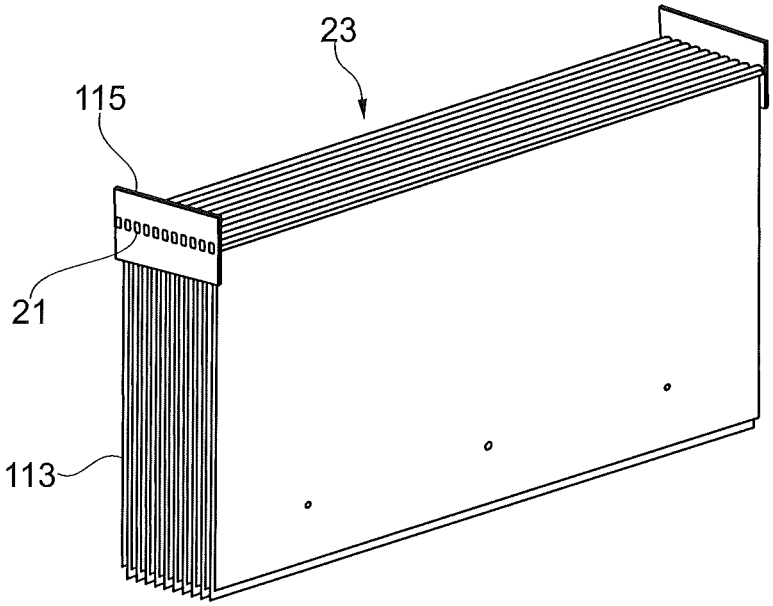
FIG. 3 shows a module of film carrying elements in accordance with an example of the invention.

As shown in FIG. 3, the modules 23 are advantageously designed as complete units including at least part of the arrangement 15 of feeding pipes 21 above the plates 113 mentioned before. Each module 23 has typically a specified capacity expressed for example as maximal mass flow rates of input steam. The condenser can then be adapted with reduced design efforts to suit the (given) thermal flow through the entire geothermal power station by assembling the appropriate number of modules 23 within one or more housings as shown above. The conduit inlets 114-1, 114-2 can be used to feed alternating every second modules 23 instead of every other pipe 21 as in the above-described variant.

Referring again to the above figures, a typical operation of the new direct contact condenser is described in the following. Thus under operating conditions a cooling liquid such as water is pumped through the dispenser system 115 and the feeding pipes 21. The flow of cooling liquid from the feeding pipes 21 generates a falling film of cooling liquid on the walls of the plates 113.

It is believed that the heat and mass transfer properties of the film at the gas liquid interface can be improved by selecting the film liquid load or flow so as to obtain a fully turbulent film on the plates' surfaces. Though turbulent, the film is designed to remain adhered to the surface without significant liquid entrainment into the gas phase. The film interface is expected to perfom most efficient when being trongly wavy within the operational range of coolant loading. A roughened or finely structured surface of the film carrier using for example a pattern of grooves can enhance the desired properties of the film.

To quantify the mass loading which is believed to cause the film to become turbulent on the surfaces of the plates 113 as opposed to maintaining a laminar flow, the film Reynolds number Re(F) is used. The film Reynolds number Re(F) is defined as being proportional to a the ratio of mass flow or load $\Gamma$ over the liquid viscosity $\eta(l)$, i.e., $\Gamma/\eta(l)$. To improve the condensation process and reduce the detrimental effect of the non-condensable gases, it is seen as advantageous to maintain a mass flow load of coolant on the film carrier 113 corresponding to a range of the film Reynolds number Re(F) of 1500 to 3000 or even 1900 to 3000. If water is used as coolant, this film Reynolds number range corresponds to a mass flow of 1.5 liters to 3.0 liters and 1.9 liters to 3.0 liters, respectively, per second per meter of film width.

Using for example plates 113 of a width of 6 m and a height of 2.5 m a water film loading $\Gamma$ of 2 kg/(m*s) yields a Reynolds film number Re(F) of approximately 2000. If it is intended to deplete an input gas/steam mixture from the turbine exhaust of about 40.37 kg/s at 0.115 bar with a non-condensable gas content NCG of 0.6 per cent content of 80 to 90 per cent of its steam content, a stack of nine modules of 20 plates each with the above dimensions is required. This stack can be housed in a condenser compartment less than 9 m wide, as each of the modules are assembled with a width of less than one meter. The total mass flow of cooling water is assumed to be 1719 kg/s with an inlet temperature of 29.5 degrees C. and an outlet temperature of 41.5 degrees C.

In order to strip the gas mixture, which leaves the first condenser compartment 11 with a mass flow rate of 9.7 kg/s and with a steam mass fraction of 0.75, of its remaining water content in the second condenser compartment 12, a (poly) propylene packing type Mellapak N125 or a similar product can be used with a cold water loading from the spray nozzles 123 of about 29 kg/(m*s) and gas loading factor for the gas mixture of 1.5. The estimated pressure drop across the packed bed is likely to be no more than 3 mbar. The estimated height of the packed bed is 1.5 m corresponding to a Number of Transfer Units (enthalpy) NTU(h) of 3.0 with HTU(h) being 0.5 m.

The stream of NCG/steam mixture at the exit 125 of the second condenser compartment can be calculated as 4 kg/s with a steam mass fraction of 0.26. A further reduction of the steam concentration can be achieved for example by providing a second smaller stripping unit with colder water.

The plates can be easy installed, maintained and cleaned. The plates can be cleaned by highly pressured water jets or by injecting for example a fast flow of water through the plates by for example reversing the hot well pump or otherwise.

The present invention has been described above purely by way of example, and modifications can be made within the scope of the invention. The invention also consists in any individual features described or implicit herein or shown or implicit in the drawings or any combination of any such features or any generalization of any such features or combination, which extends to equivalents thereof. Thus, the breadth and scope of the present invention should not be limited by any of the above-described exemplary embodiments.

Each feature disclosed in the specification, including the drawings, may be replaced by alternative features serving the same, equivalent or similar purposes, unless expressly stated otherwise.

Unless explicitly stated herein, any discussion of the prior art throughout the specification is not an admission that such prior art is widely known or forms part of the common general knowledge in the field.

The invention claimed is:

1. An apparatus for condensing steam, comprising:

at least two chambers with, a first chamber operated as co-current flow condensing chamber including a cooling liquid distribution system with a plurality of channels arranged above a plurality of film carriers having flat surface areas to carry films of cooling liquid, with the film carriers arranged in modules with each of the modules including elements to fix the modules to neighboring modules or to a housing, and further including at least parts of the cooling liquid distribution system, and a second chamber operated as counter-current flow condensing chamber.

2. The apparatus of claim 1, wherein the film carriers include a plurality of essentially flat plates.

3. The apparatus of claim 1, wherein the film carriers include a plurality of essentially flat metal plates.

4. The apparatus of claim 1, wherein the cooling liquid distribution system generates a turbulent film on faces of the film carriers.

5. The apparatus of claim 1, wherein the cooling liquid distribution system releases a flow of coolant with a film Reynolds number Re(F) in the range of 1500 to 3000.

6. The apparatus of claim 1, wherein the cooling liquid distribution system releases a flow of water at a rate of 1.5 liters to 3.0 liters per second per meter of films width.

7. The apparatus of claim 1, wherein the cooling liquid distribution system includes pipes in which coolant flows in mutually opposing directions.

8. The apparatus of claim 1, wherein the cooling liquid distribution system includes pipes with a bottom slit partly filled by an upper edge of the film carriers, leaving two gaps for a flow of coolant onto opposing faces of the film carriers.

9. The apparatus of claim 1, wherein a pressure drop of the films of cooling liquid across a film dispenser device is lower than 300 mbar.

10. The apparatus of claim 1, wherein the cooling liquid distribution system includes pipes with a bottom slit partly filled by an upper edge of the film carriers, the upper edge held in place by a sheet or sheets leaving a plurality of openings for a flow of coolant onto opposing faces of the film carriers.

11. The apparatus of claim 1, wherein the cooling liquid distribution system includes pipes with an oval cross-section.

12. The apparatus of claim 1, wherein the cooling liquid distribution system includes pipes arranged into at least two rows with a lower row shifted, relative to an upper row, vertically by approximately one pipe diameter and horizontally by approximately half of one pipe diameter.

* * * * *